United States Patent [19]

Okura et al.

[11] 4,047,597

[45] Sept. 13, 1977

[54] GUIDE DEVICE FOR ELEVATOR

[75] Inventors: Masaatsu Okura; Kazutoshi Ota; Sadayuki Otomi, all of Inazawa, Japan

[73] Assignee: Mitsubishi Denki Kabushiki Kaisha, Tokyo, Japan

[21] Appl. No.: 649,204

[22] Filed: Jan. 14, 1976

[30] Foreign Application Priority Data

Jan. 14, 1975 Japan ..... 50-6805

[51] Int. Cl.[2] ..... B66B 7/04

[52] U.S. Cl. ..... 187/95; 308/3 B

[58] Field of Search ..... 187/1 R, 95; 308/3 B, 308/3 R; 267/33

[56] References Cited

U.S. PATENT DOCUMENTS

| | | | |
|---|---|---|---|
| 857,725 | 6/1907 | Donohue | 187/95 |
| 1,032,454 | 7/1912 | Wainwright | 267/33 |
| 1,855,253 | 4/1932 | Moore et al. | 267/33 X |
| 1,899,751 | 2/1933 | Dunlop | 187/95 |
| 1,916,365 | 7/1933 | Dunlop | 187/95 |
| 2,005,089 | 6/1935 | Krebs | 267/33 X |
| 2,057,118 | 10/1936 | Sanford | 308/3 B |
| 2,601,503 | 6/1952 | Cornish | 187/95 |
| 3,425,516 | 2/1969 | Jin et al. | 187/95 |
| 3,762,694 | 10/1973 | MacDonnell | 267/33 X |

*Primary Examiner*—Evon C. Blunk
*Assistant Examiner*—James L. Rowland
*Attorney, Agent, or Firm*—Oblon, Fisher, Spivak, McClelland & Maier

[57] ABSTRACT

A guide device for guiding an elevator during its ascending and descending movement features a pair of guide rails disposed on opposite sides of the elevator body in parallel relation with the vertical line of movement of the elevator body and spaced apart to provide a gap between the sides of the elevator body and the guide rails, a plurality of guides carried by the elevator body and being interlocked with the guide rails on both sides of the elevator body to guide the vertical movement of the elevator body along the guide rails, and the guides being slidably disposed on the elevator body and spring biased in the direction of the guide rails so as to maintain the guides in interlocked relation with the guide rails in their normal state and to project the guide further in the corresponding direction of one of the guide rails when the elevator is shifted accidentally to one side to bend the other guide rail, upon collision therewith, and thus prevent derailment of the elevator from the guide rails.

1 Claim, 3 Drawing Figures

GUIDE DEVICE FOR ELEVATOR

BACKGROUND OF THE INVENTION

1. Field of the Invention:

The present invention relates to guide devices for guiding the descent and ascent of an elevator body, such as a cage, which are mounted on the elevator body and are slidably interlocked to a pair of guide rails.

2. Description of the Prior Art:

Generally, an elevator body is guided in its descent and ascent through guide devices thereon which are slidably interlocked on a pair of guide rails having a T-shaped cross-section and being disposed at both sides of the elevator body.

Heretofore, a conventional guide device has a guide groove which is shaped to correspond to the end surface and both side surfaces of the leg of a T-shaped guide rail. Accordingly, when a body of an elevator is severely swung, by an earthquake or the like, to cause it to collide with the guide rail, and at least one of the pair of guide rails in outwardly bent, a gap is caused between the guide device and the guide rail to cause it to derail because of the small allowance of the interlocking engagement. Thus, the body of the elevator is readily accidentally derailed from its predetermined passage to collide with other devices of the elevator.

A conventional guide device which is pushed on a guide rail, to be shiftable, is known. However, the conventional guide device is only for reducing vibration during the descending and ascending movements of a body of an elevator and provides only a small shiftable allowance. Accordingly, it has been hard to prevent derailing from a guide rail when the guide rail is actually bent by a severe earthquake or the like.

SUMMARY OF THE INVENTION

It therefore is an object of the present invention to provide an improved guide device for an elevator which overcomes the above mentioned disadvantages and lightens a shock caused by a collision of a body of an elevator with a guide rail and maintains an interlocking condition therebetween when a guide rail is bent.

The foregoing object, and others as well, of the present invention have been attained by providing a guide device for an elevator which comprises a spring and a buffer held between the elevator body and a slidable guide, whereby the slidable guide can be projected toward the guide rail by at least the spring, whereby a shock caused by a collision of the elevator body with the guide rail is lightened by the buffer to reduce the degree of bending of the guide rail and the slidable guide disposed at the opposite side of the elevator of the bent guide rail is projected by its spring to prevent a derailment of the elevator body from the guide rails.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference numerals designate like or corresponding parts throughout the several views and wherein.

DETAILED DESCRIPTION OF THE PREFERRED EMBODIMENTS

Figure 1:
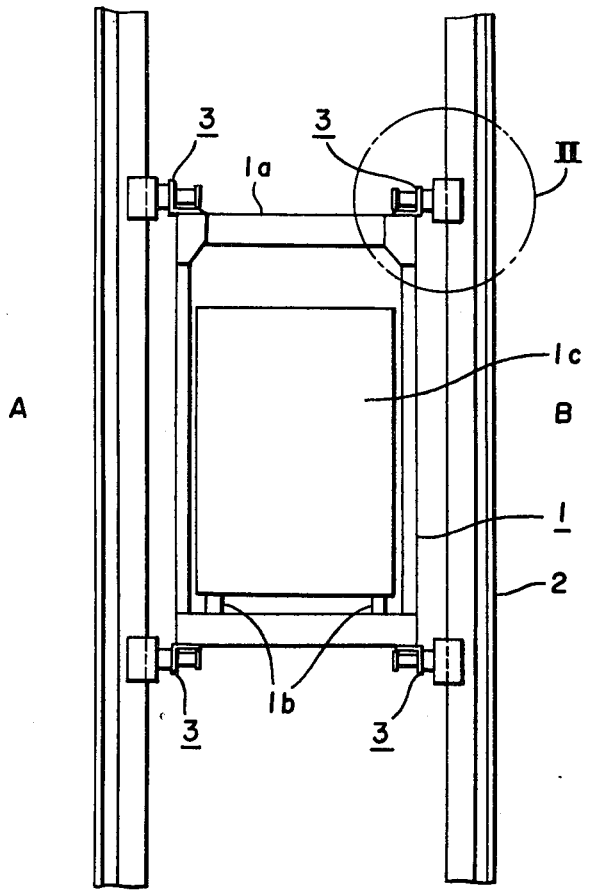
FIG. 1 is a front view of one embodiment of a cage of an elevator which has guide devices according to the present invention.
Figure 2:
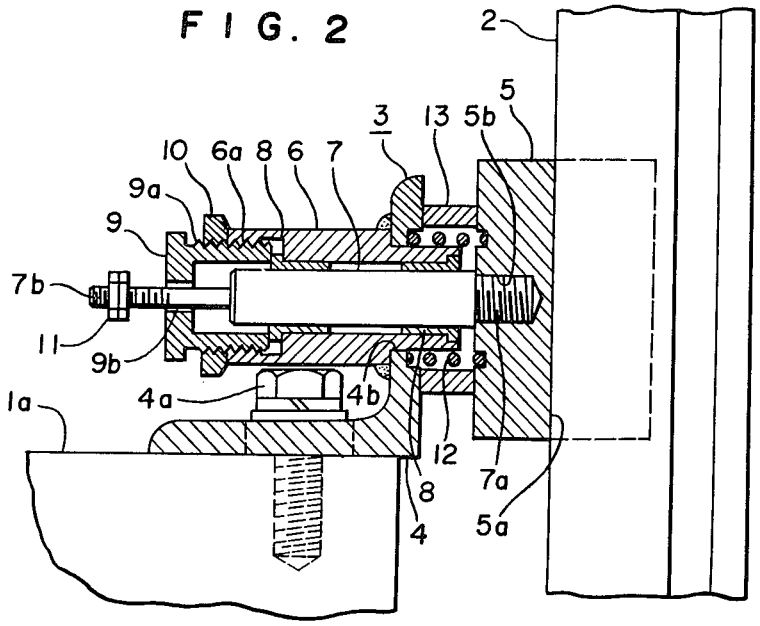
FIG. 2 is a partially enlarged sectional view of the guide device of FIG. 1.
Figure 3:
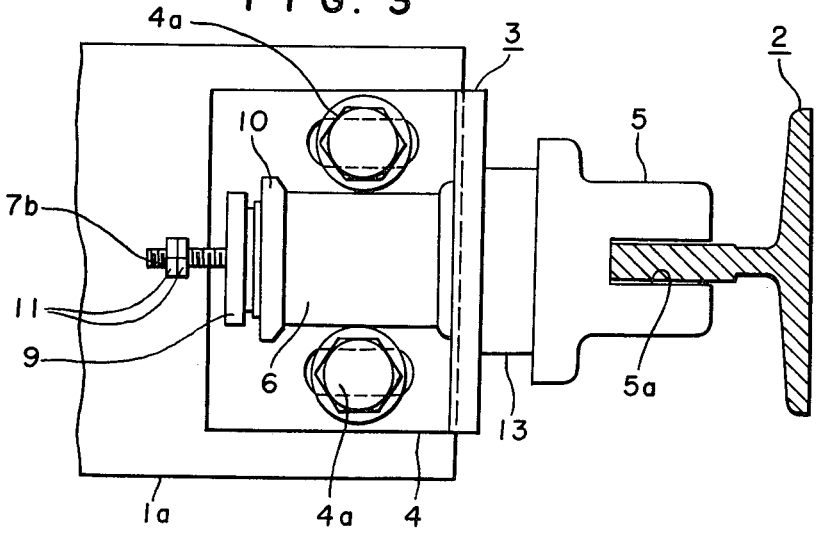
FIG. 3 is a plan view of the guide device of FIG. 2.

Referring now to the drawings, and more particularly to FIGS. 1 - 3, one embodiment of the guide for an elevator according to the present invention will be described. A body of an elevator such as a cage 1, is shown having a frame 1*a* and a chamber or compartment 1*c* disposed thereon through shockproof rubber or other suitable resilient elements 1*b*. A pair of guide rails 2 of T-shaped configuration in cross-section are disposed at both sides of the elevator body 1 and are fixed on a wall of a passage of the body, not shown, with the legs of the pair of guide rails facing each other.

Guide devices 3 are respectively disposed on the four corners of the frame 1*a*. Each guide device 3 includes an L-shaped holder 4 fixed on the frame 1*a* by bolts 4*a* and a sliding guide 5, such as a sliding shoe, having an interlocking vertical groove 5*a* which is slidably fitted on the leg of the T-shaped guide rail 2, carried thereby. The sliding guide 5 is carried by the L-shaped holder 4 through a hollow cylindrical holder 6, which passes through a hole 4*b* formed in the center of a vertical leg of the L-shaped holder 4 and is securely fixed thereto, as by welding, and a slidable shaft 7 screwed at an end screw portion 7*a* thereof to a tapped hole 5*b* formed on the back of the sliding guide 5 and freely fitted in the hollow part of the cylindrical holder 6 so as to be slidably held therein for movement in the axial direction. A slide bearing 8 is disposed between the slidable shaft 7 and the hollow cylindrical holder 6.

A pressing piece 9 is screwed to a tapped hole 6*a* formed on the inner surface of the end of the hollow cylindrical holder 6 and the inside end of the pressing piece 9 is contacted with the slide bearing 8. A lock nut 10 is screwed on the threaded portion 9*a* formed on the outer surface of the pressing piece 9 so as to prevent unfastening of the pressing piece 9.

Screwed on a threaded portion 7*b* formed at the rearward end of the slidable shaft 7 projecting through a central hole 9*b* of the pressing piece 9 behind the pressing piece 9 is a nut 11. The nut 11 operates as a stopper which prevents the slidable shaft 7 from being pulled out of the cylindrical holder 6. A spring, shown being a compressed coil spring 12, is held at each of its ends between annular concave parts formed at the outer part of a hole 4*b* of the L-shaped holder 4 and at the back surface of the sliding guide 5. The initial pressure of the spring 12 can be controlled by varying the degree to which the nut 11 is threaded onto the slidable shaft.

A hollow cylindrically shaped buffer 13 made of a shock-proof rubber or similar material is disposed between the L-shaped holder 4 and the sliding guide 5 and around the spring 12. At least one end of the buffer 13 is fixed on either the L-shaped holder 4 on the sliding guide 5, while the other end can be free. That is, the spring 12 and the buffer 13 are disposed so as to compress the sliding guide 5 in the direction of the guide rail 2. The spring constant of the spring 12 is set to be smaller than that of the buffer 13.

The guide device 3 slides under interlocking with the guide rail 2 during the ascent and descent of the elevator body 1, the guide 5 being compressed against the guide rail 2 by the spring 12 or by both the spring 12 and the buffer 13. When the body of the elevator 1 is swung by an earthquake or a similar shock, and the body 1 collides with the guide rail 2 at the A side thereof, as seen in FIG. 1, the collision force is applied through the guide device 3 to the guide rail 2. The collision force is lightened by the buffer 13 of the guide device 3, whereby the degree of bending of the guide rail 2 at the A side is reduced. When the guide rail 2 at the A side is bent, the gap between the guide rail 2 at the B side and the corresponding side surface of the body of the elevator 1 is broadened. Thus, the slidable guide 5 at the B side is projected further in the direction of the corresponding guide rail 2 by the spring 12 thereof. Accordingly, the interlocking of the interlocking part of the slidable guide 5 with the guide rail 2 can be kept in a normal condition, since enough projectable length of the slidable guide and compressible length of the spring 12 are provided so as to keep the interlocking of the slidable guide 5 with the guide rail 2 at the B side even though the guide rail 2 at the A side is bent in an elastic deformation.

According to the tests, the projectable and compressible length is usually longer than 10 mm, and preferably longer than several tens of mm. According to the structure of the invention, even though the body of the elevator 1 collides with the guide rail 2, it is possible to prevent a derailment of the body of the elevator 1 from the guide rail 2. Thus, not only can the degree of bending of the guide rail 2 caused by a collision of the elevator 1 be reduced by the buffer 13, but when the guide rail 2 is bent, the slidable guide 5 at the opposite side is projected to maintain the interlocking relation of the slidable guide 5 with the guide rail 2. Accordingly, the derailment of the elevator 1 from the guide rail 2 can be prevented and an accident caused by such derailment can be prevented.

In the embodiment described, the spring 12 and the buffer 13 are disposed in parallel relation. It is clear, however, that a similar effect can be attained by disposing the spring and the buffer in a series arrangement. It is also clear that a similar effect can be attained even though the body of the elevator 1 is a counterweight in the embodiment of FIGS. 1 to 3.

As illustrated, the invention is to provide a spring and a buffer disposed between the body of an elevator and the slidable guide to project the slidable guide toward the corresponding guide rail by the force of at least the spring, by more than 10 mm, whereby the shock of collision of the body of the elevator against the guide rail by a swinging thereof is lightened by the buffer so as to reduce the degree of bending of the guide rail, and also the slidable guide disposed on the opposite elevator side of the bent guide rail is projected toward the corresponding guide rail by the spring so as to prevent a derailment of the body of the elevator from the guide rail. An accident involving derailment of an elevator can thus be prevented.

Obviously, many other modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A guide device for an elevator body, the elevator body being movable along first and second parallel guide rails, the guide device comprising:

a first sliding guide, the first sliding guide being slidably movable along the first guide rail, a first hollow holder, a first shaft slidably disposed within the first hollow holder and connected to the first sliding guide, the first shaft having a stop associated therewith so as to permit the first shaft to be slidably displaced within the first hollow holder a distance of greater than 10 mm., a first buffer of resilient material disposed between the first hollow holder and the first sliding guide and being connected to one but not the other, a first compressed spring being disposed between the first hollow holder and the first sliding guide to force the first hollow holder away from the first sliding guide, the first hollow holder being connected to the elevator body, a second sliding guide, the second sliding guide being slidably movable along the second guide rail, a second hollow holder, a second shaft slidably disposed within the second hollow holder and connected to the second sliding guide, the second shaft having a stop associated therewith so as to permit the second shaft to be slidably displaced within the second hollow holder a distance of greater than 10 mm., a second buffer of resilient material disposed between the second hollow holder and the second sliding guide and being connected to one but not the other, a second compressed spring being disposed between the second hollow holder and the second sliding guide to force the second hollow holder away from the second sliding guide, the second hollow holder being connected to the elevator body, whereby, when the elevator body is forced towards the second guide rail, the second buffer prevents the force of the elevator body from being transmitted in its entirety to the second sliding guide in order to permit the second sliding guide to remain in alignment with the second guide rail and whereby, when the elevator body is forced towards the second guide rail, the slidable first shaft permits the first hollow holder to be displaced away from the first slide guide by an additional distance greater than 10 mm. in order to permit the first sliding guide to remain in alignment with the first guide rail.

* * * * *